US006327974B1

(12) United States Patent
Belanger et al.

(10) Patent No.: US 6,327,974 B1
(45) **Date of Patent: *Dec. 11, 2001**

(54) SPRAY DAMPENING DEVICE HAVING HIGH EFFECTIVE SPRAY FREQUENCY AND METHOD OF USING

(75) Inventors: James Richard Belanger, Portsmouth; Douglas Joseph Dawley, Epping, both of NH (US)

(73) Assignee: Heidelberger Druckmaschinen AG, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/259,927

(22) Filed: Mar. 1, 1999

(51) Int. Cl.[7] ..... B41F 7/30; B41F 33/16; B41L 25/06

(52) U.S. Cl. ..... 101/147; 118/315; 118/704; 101/484

(58) Field of Search ..... 101/147, 148, 101/366, 365, 351.8, 484; 239/551, 556, 563, 70; 118/300, 313, 314, 315, 259, 696, 699, 702, 704; 427/421

(56) References Cited

U.S. PATENT DOCUMENTS

| | | | | |
|---|---|---|---|---|
| 4,064,801 | | 12/1977 | Switall | 101/147 |
| 4,198,907 | | 4/1980 | Switall | 101/147 |
| 4,211,258 | | 7/1980 | Switall | 137/862 |
| 4,465,714 | * | 8/1984 | Petro, IV | 427/424 |
| 4,469,024 | * | 9/1984 | Schwartz et al. | 101/147 |
| 4,649,818 | | 3/1987 | Switall et al. | 101/147 |
| 4,708,058 | | 11/1987 | Smith | 101/147 |
| 4,815,375 | | 3/1989 | Switall et al. | 101/148 |
| 4,899,653 | * | 2/1990 | Michl et al. | 101/148 |
| 5,038,681 | * | 8/1991 | Hultberg | 101/148 |
| 5,887,521 | * | 3/1999 | Nakamura et al. | 101/147 |

FOREIGN PATENT DOCUMENTS

| | | | |
|---|---|---|---|
| 35 45 535-A1 | * | 7/1987 | (DE) . |
| 0 325 381 | | 7/1989 | (EP) . |
| 0 341 384 | | 11/1989 | (EP) . |

* cited by examiner

*Primary Examiner*—John S. Hilten
*Assistant Examiner*—Leslie J. Grohusky
(74) *Attorney, Agent, or Firm*—Kenyon & Kenyon

(57) ABSTRACT

A spray dampening device for a printing apparatus, the spray dampening device comprising a plurality of spray nozzles. The spray nozzles are each cycled at a predetermined frequency and at an individual nozzle phase shift with the individual phase shifts being synchronized so that an effective frequency of spray bursts applied to target surface of the printing apparatus is greater than the predetermined frequency. Dampening system performance may be improved without the implementation of new individual nozzle technology. The benefits of a pulsed dampener system are maintained while system performance approaches that of a continuous dampener.

22 Claims, 5 Drawing Sheets

State of the art

State of the art

State of the art

SPRAY DAMPENING DEVICE HAVING HIGH EFFECTIVE SPRAY FREQUENCY AND METHOD OF USING

FIELD OF THE INVENTION

The present invention relates generally to printing machines and more particularly to a spray dampening system for a printing press.

RELATED TECHNOLOGY

In modern printing processes, including offset lithographic processes, a wetting solution and ink are applied to certain rollers of a printing press. The ink is subsequently transferred to a printed medium, such as paper. The wetting solution is applied in sufficient quantities to the rollers to facilitate the printing process and aid in proper application of the ink to the paper. The wetting solution, which is typically a water-based solution which repels the ink, adheres to blank portions of an image plate and helps prevent the application of ink to the blank areas.

Control of the amount and distribution of the applied wetting solution is critical. Insufficient wetting tends to encourage the ink to migrate to improper portions of the plate and thereby be transferred to corresponding areas of the paper which are not to be printed. Excess wetting results in waste which must be collected and removed from the system, and may even cause wetting of the paper to be printed. A smooth, even application of the wetting solution without excess is desirable.

Spray dampening systems, such as that described in Switall et al., U.S. Pat. No. 4,649,818, have been developed which employ solenoid-operated spray nozzles to apply the wetting fluid to a roller. The spray nozzles are typically arranged on a spray bar. Such spray dampening systems meter wetting fluid flow rates by cycling the solenoid-operated spray nozzles at various frequencies and duty cycles. The resulting periodic, non-continuous application of wetting solution to a roller results in periodic variations in the distribution of wetting solution on the roller. If the variations are too large, defects in the printed product may occur.

Two approaches have been attempted with prior dampening systems to reduce variations in the distribution of wetting solution on a roller. One approach increases the frequency of cycling of the spray nozzles to more closely approximate a continuous application of wetting solution to a roller. However, improvements achievable with this approach are limited, as it is difficult and expensive to increase the spray nozzle cycling frequency. This upper limit exists due to current nozzle technology and physical limitations. Also, higher spray nozzle cycling frequencies can lead to problems such as "misting" of wetting solution, resulting in its deposition in unwanted areas of the image plate. A second approach is to design and employ a dampener roll which filters out variations in the applied spray, producing a more continuous, uniform distribution of wetting solution. This approach may require unwieldy dampener rolls which are both difficult to package and prohibitively expensive.

SUMMARY OF THE INVENTION

The present invention provides a spray dampening device for a printing apparatus, the spray dampening device comprising a plurality of spray nozzles for applying spray bursts to a surface of a target of the printing apparatus. Each of the spray nozzles is cycled at a predetermined frequency and at an individual nozzle phase shift, the individual nozzle phase shifts being synchronized so that an effective frequency of spray bursts applied to the surface is greater than the predetermined frequency.

The present invention also provides method for spray dampening a printing device, the method comprising spraying a dampening solution in spray bursts through a plurality of spray nozzles to a surface of a target apparatus, and cycling each of the spray nozzles at a predetermined frequency and at an individual nozzle phase shift. The individual phase shifts are synchronized so that an effective frequency of spray bursts applied to the surface is greater than the predetermined frequency.

The present invention thus may provide increased effective dampening spray burst frequencies beyond limits approached by individual nozzles. Dampening system performance may be improved without the implementation of new individual nozzle technology. The benefits of a pulsed dampener system may be maintained while system performance approaches that of a continuous dampener.

BRIEF DESCRIPTION OF THE DRAWINGS

In the following, the present invention is explained in more detail with the aid of the drawings, in which.

DETAILED DESCRIPTION

Figure 1B:
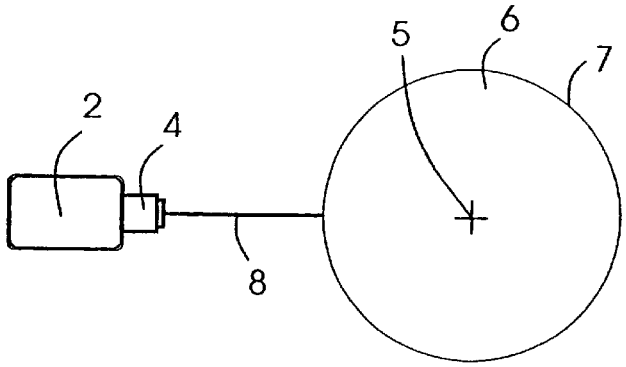
FIG. 1B shows a side cross-sectional schematic view of the prior art spray dampening device of FIG. 1A.
Figure 1A:
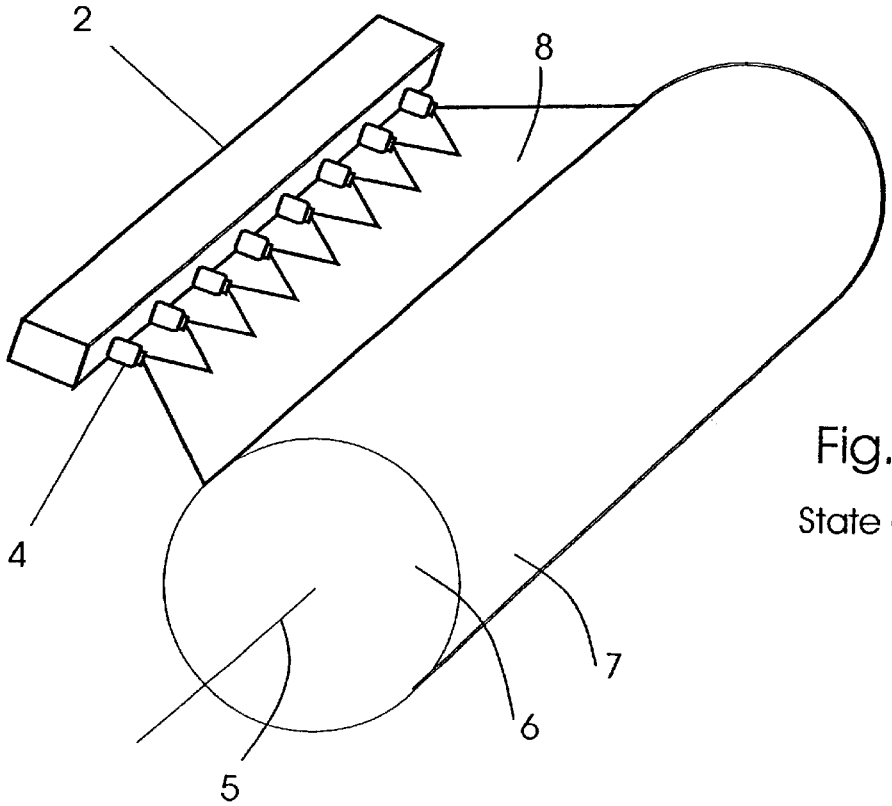
FIG. 1A shows a perspective view of a prior art spray dampening device.
Figure 1C:
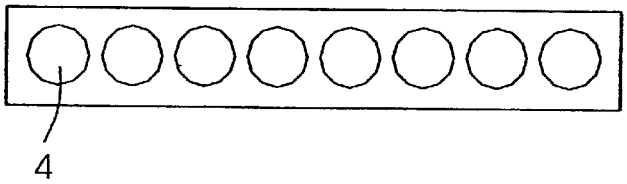
FIG. 1C shows a schematic view of the spray nozzle arrangement of the prior art spray dampening device shown in FIG. 1A.
Figure 2B:
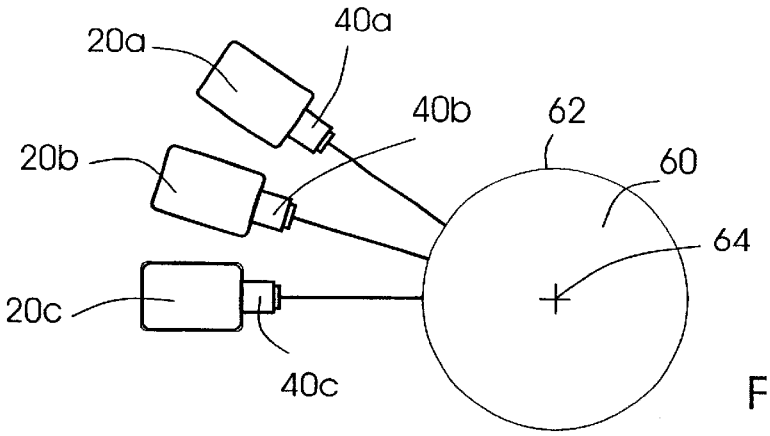
FIG. 2B shows a cross-sectional schematic view of the spray dampening device of FIG. 2A.
Figure 2A:
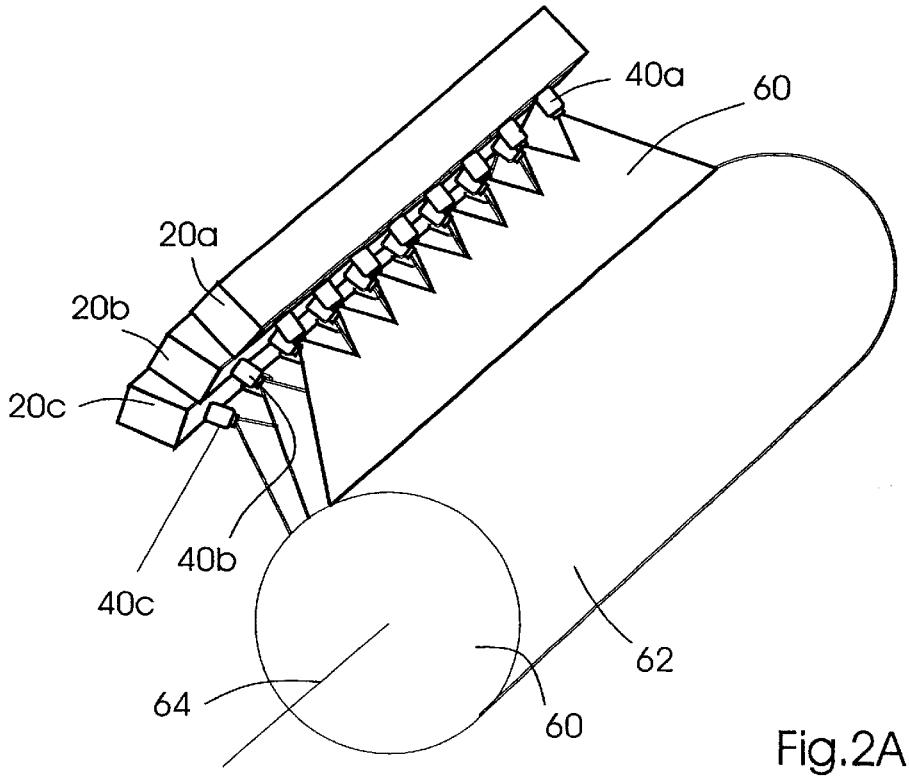
FIG. 2A shows a perspective view of an embodiment of a spray dampening device according to the present invention.
Figure 2C:
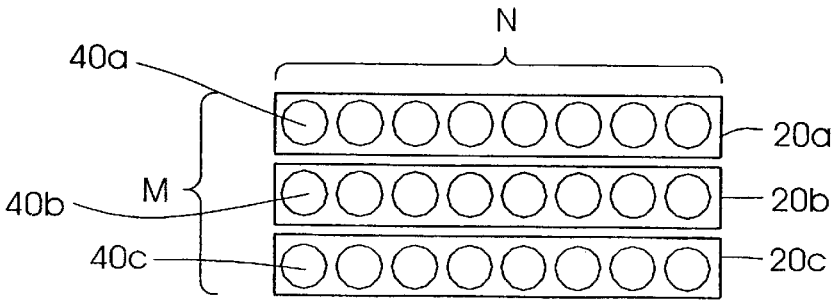
FIG. 2C shows a schematic view of the spray nozzle arrangement of the spray dampening device shown in FIG. 2A.

To better understand the present invention, which is shown in FIGS. 2A, 2B and 2C, a prior art spray dampening device is described in FIGS. 1A, 1B and 1C. The spray dampening device is a part of a printing apparatus. FIG. 1A shows a perspective view of a prior art spray dampening device having spray bar 2, spray nozzles 4, and generally cylindrical roller 6. Roller 6 rotates about longitudinal axis 5. Pressurized wetting solution fed through spray bar 2 is applied via spray 8 to moving surface 7 of roller 6 by pulse-cycling spray nozzles 4 open and closed. The spray nozzles are typically cycled all at the same time at a common frequency, which may be varied based on a various parameters, such as the speed of the printing apparatus. FIG. 1B provides a side cross-sectional schematic view of the prior art spray dampening device shown in FIG. 1A. As shown in the schematic view of FIG. 1C, as well as in FIGS. 1A and 1B, the spray nozzles of the prior art spray dampening device are arranged in a row generally parallel to longitudinal axis 5 of roller 6.

FIGS. 2A, 2B and 2C depict an embodiment of a spray dampening device according to the present invention. Three spray bars 20*a*, 20*b* and 20*c* are provided with spray nozzle sets 40*a*, 40*b* and 40*c*, respectively, the spray nozzles being arranged in a row on each of their respective spray bars. The spray nozzles deposit sprays 80 of wetting solution onto moving surface 62 of generally cylindrical roller 60 as the roller rotates about longitudinal axis 64. The spray bars are arranged above surface 62 so that the spray nozzles form a rectangular array of M×N nozzles, M being the number of rows and N being the number of columns of nozzles, as shown in FIG. 2C. In the embodiment depicted, M is equal to three and N equal to eight.

As embodied herein, the spray nozzle sets 40*a*, 40*b* and 40*c* are pulse-activated, i.e., cycled open and shut, at a predetermined frequency f. As embodied herein, the nozzles are synchronized to alternately cycle as follows:

The cycling of nozzle set 40*b* is phase-shifted to cycle later relative nozzle set 40*a*, while the cycling of nozzle set 40*c* is phase-shifted to cycle later relative to nozzle set 40*b*. The phase shifts are established so that nozzle set 40*a* sprays a burst of wetting solution against the moving surface 62 of roller 60 at a time $t_a$. Then at time $t_b$, a predetermined phase shift, or time delay, later, nozzle set 40*b* sprays a burst of wetting solution against surface 62. Similarly, nozzle set 40*c* then sprays a burst of wetting solution against surface 62 at a time $t_c$, which is a predetermined phase shift from the cycling of nozzle set 40*b*. The nozzle sets thus spray in sequence, one after the other, starting with nozzle set 40*a*. The sequence preferably continues in a cyclic manner—40*a*, 40*b*, 40*c*, 40*a*, 40*b*, 40*c*, etc. The phase shift between nozzle sets 40*a* and 40*b* is preferably the same as the phase shift between nozzle sets 40*b* and 40*c* so that the time delay between the cycling of each set of spray nozzles is the same. Also, the amount of time the nozzles of each nozzle set are open and closed is preferably the same for all nozzles, so that the duty cycle is the same for all the nozzles.

Figure 3A:
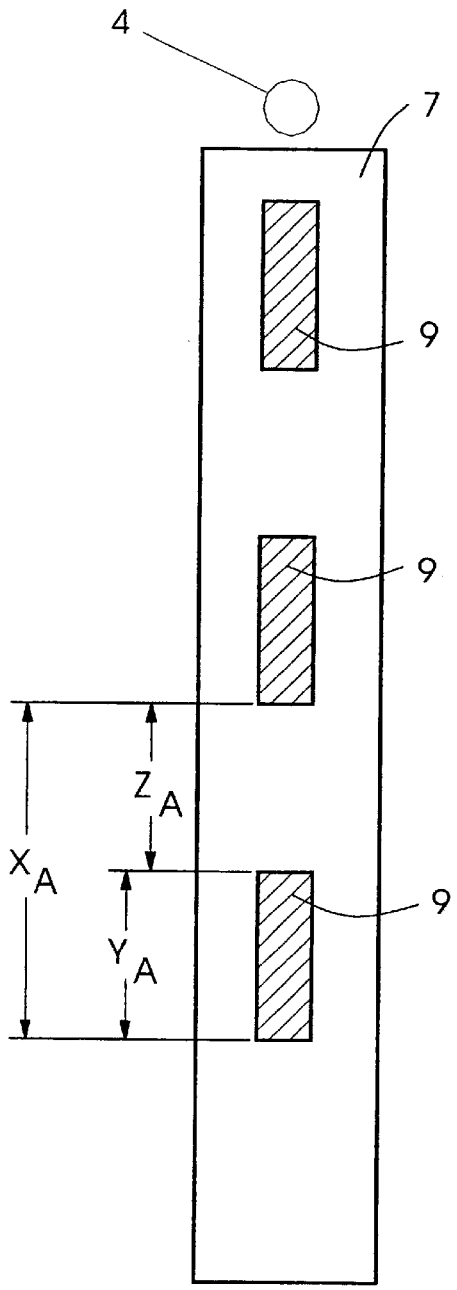
FIG. 3A shows a schematic unwrapped, flattened view of a portion of the surface of the roller of the prior art spray dampening device shown in FIG. 1A, for demonstrating the spray coverage of the device.
Figure 3B:
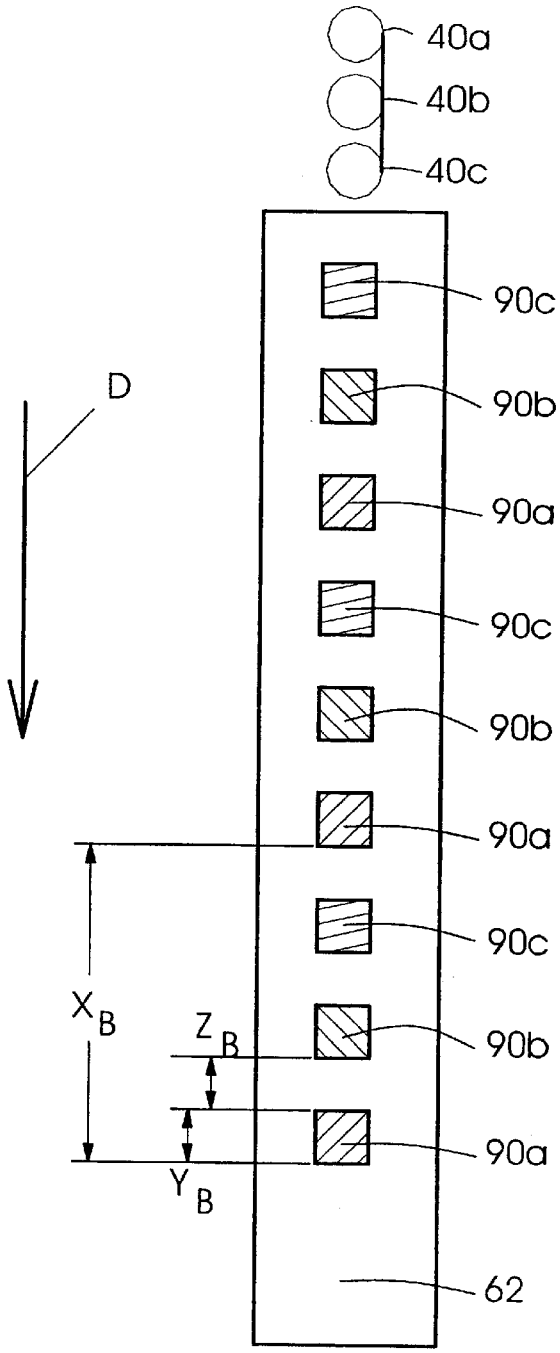
FIG. 3B shows a schematic unwrapped, flattened view of a portion of the surface of the roller of the spray dampening device according to the present invention shown in FIG. 2A, for demonstrating the spray coverage of the device.

Reference may now to had to FIGS. 3A and 3B, with which the effect of the synchronized, phase-shifted cycling of the spray nozzle sets according to the present invention may be conveniently demonstrated. FIG. 3A shows a schematic unwrapped, flattened view of a portion of the surface 7 of roller 6 of the prior art spray dampening device shown in FIGS. 1A, 1B and 1C, and discussed above. Spray areas 9 represent, in simplified form, the wetting solution coverage of surface 7 due to individual, sequential bursts of spray from spray nozzle 4 as surface 7 moves pasts nozzle 4 in a direction D due to the rotation of roller 6. $X_A$, as shown, represents the pulse, or cycling, period of nozzle 4. $X_A$ is a function of both the nozzle cycling frequency and the surface (tangential) velocity of surface 7. Spray area length $Y_A$ and dry length $Z_A$ are functions of the nozzle duty cycle and the surface velocity of surface 7.

FIG. 3B shows a schematic unwrapped, flattened view of a portion of surface 62 of roller 60 of the embodiment of the spray dampening device according to the present invention shown in FIGS. 2A, 2B and 2C, and discussed above. Three spray nozzles 40*a*, 40*b* and 40*c* are shown, which represent one column of the M×N nozzle array shown in FIG. 2C. Spray areas 90*a*, 90*b* and 90*c* represent, in simplified form, the wetting solution coverage of surface 62 due to individual, sequential bursts of spray from spray nozzle 40*a*, 40*b* and 40*c* as surface 62 moves pasts the nozzles in direction D due to the rotation of roller 60. Nozzles 40*a*, 40*b* and 40*c* are cycled, or pulsed, open and closed in a phase-shifted, sequential synchronized cyclic fashion, as described above. As embodied herein, the nozzle cycling frequency f of an individual nozzle is the same for all three nozzles 40*a*, 40*b* and 40*c*. $X_B$ represents the cycling period of one nozzle. $Y_B$ and $Z_B$ represent the spray area length and dry length, respectively, applied to surface 62. When the nozzle cycling frequency f is equal to the cycling frequency of the prior art spray dampener device shown in FIG. 3A and the surface (tangential) velocity of surface 62 is equal to the surface velocity of surface 7 of the prior art spray dampener device shown in FIG. 3A, cycling period $X_B$ equals $X_A$, the cycle period of the prior art spray dampener device shown in FIG. 3A. As embodied herein, the cycling time of nozzles 40*a*, 40*b* and 40*c* is set so that spray area length $Y_B$ is equal to one third of $Y_A$, the spray length of the prior art spray dampener device shown in FIG. 3A, and the dry distance $Z_B$ is equal to one third of $Z_A$, the dry distance of the prior art spray dampener device shown in FIG. 3A.

As is apparent from FIGS. 3A and 3B, the spray dampening device of the present invention advantageously enables three spray bursts to be applied to the roller 60 in the same period ($X_B$=$X_A$) as one spray burst is applied in the prior art device. The effective spray frequency applied to the roller is thus three times that of the prior art device. In other embodiments, the spray dampening device of the present invention may be provided with other numbers of spray bars 20, and, consequently, of rows M of spray nozzles. In general, when M rows of nozzles are used, with synchronized, phase-shifted cycling, as described above, the present invention advantageously provides an effective spray frequency applied to surface 62 of M times the cycle frequency of an individual spray nozzle.

Figure 4:
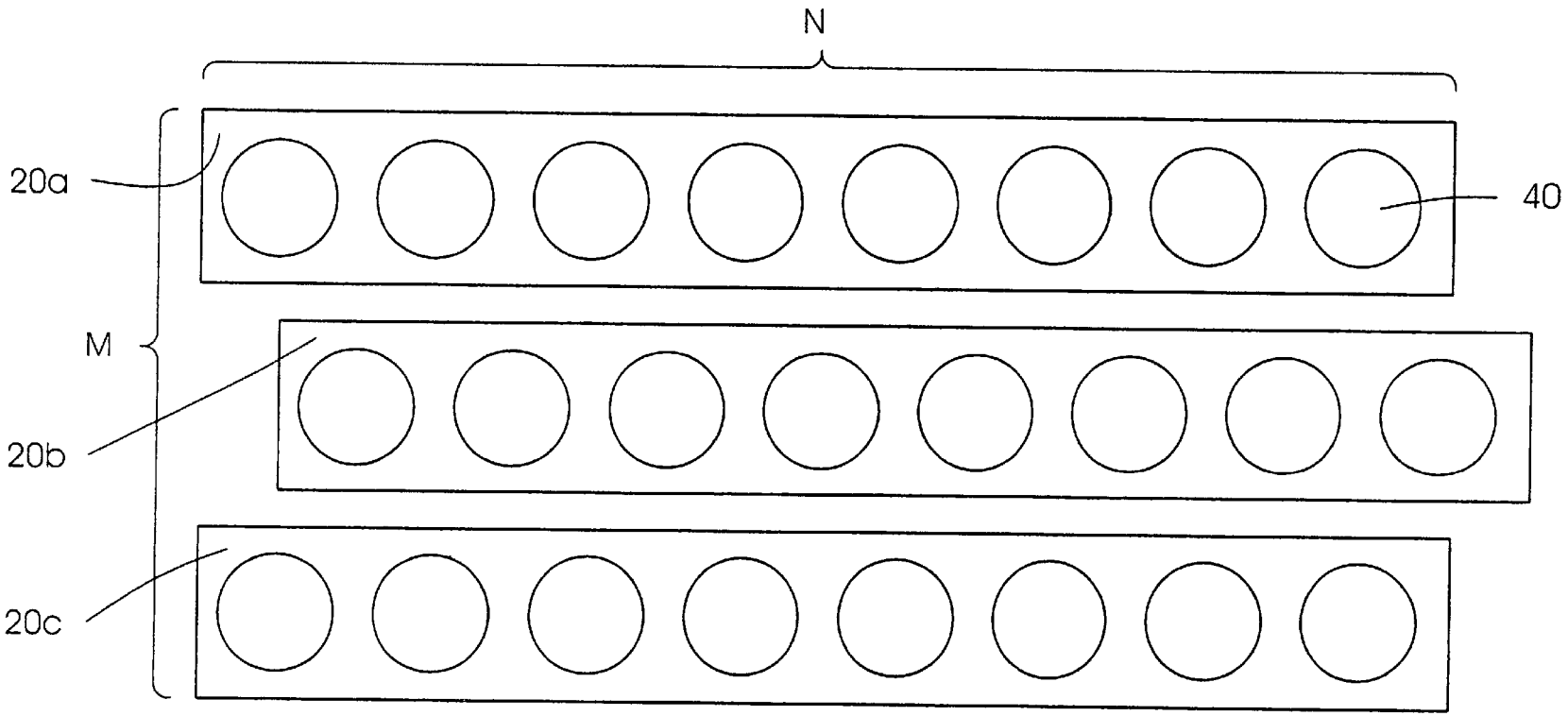
FIG. 4 shows a schematic view of the spray nozzle arrangement of another embodiment of the spray dampening device according to the present invention having an array of staggered spray nozzles.

FIG. 4 shows an alternate embodiment of the present invention in which the M×N array of spray nozzles 40 is configured in a staggered arrangement, the nozzles on spray bar 20*b* being shifted laterally relative to the spray nozzles of spray bars 20*a* and 20*c*. The staggered arrangement shown provides a corresponding staggered spray pattern on the surface 62 of roller 60.

Figure 5A:
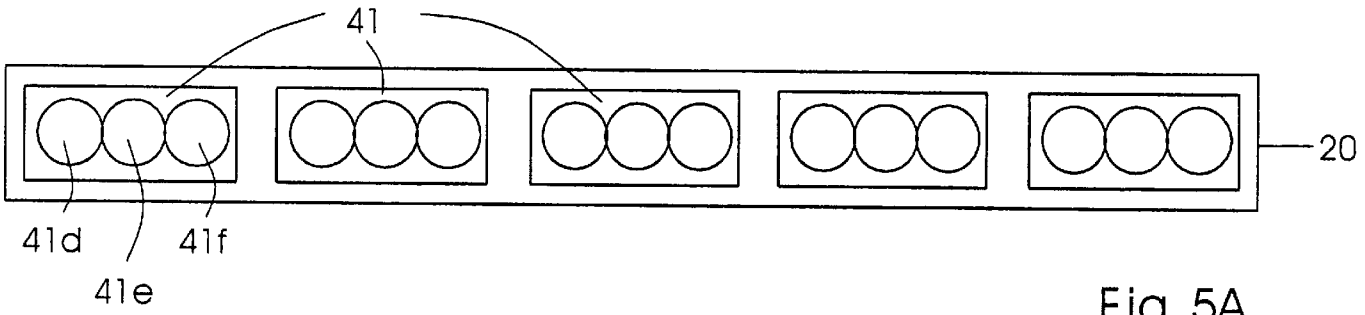
FIG. 5A shows a schematic view of the spray nozzle arrangement of another embodiment of the spray dampening device according to the present invention having grouped spray nozzles.

FIG. 5A shows an embodiment of the present invention in which spray nozzles are arranged in lateral groups 41 on a spray bar 20, each group having, for example, three spray nozzles 41*d*, 41*e* and 41*f*. The three nozzles in a group are oriented to spray all at the same general area on surface 62 of roller 60. As embodied herein, the three nozzles in each group cycle in a phase-shifted, sequential manner. In a group 41, nozzle 41*d* cycles open and shut, followed by the cycling of nozzle 41*e* a predetermined time delay later. Then nozzle 41*f* cycles with the same time delay after nozzle 41*e*. Preferably the three nozzles in the other groups 41 are synchronized to cycle in the same time delay pattern, and at the same times, i.e., with the same frequency. In other embodiments of the present invention, varying phase shift patterns and nozzle cycling frequencies may be employed. Each spray nozzle group of a spray dampening device in accordance with this embodiment of the present invention will produce a spray coverage pattern on surface 62 similar to that shown in FIG. 3B, while the nozzles occupy less space.

Figure 5B:
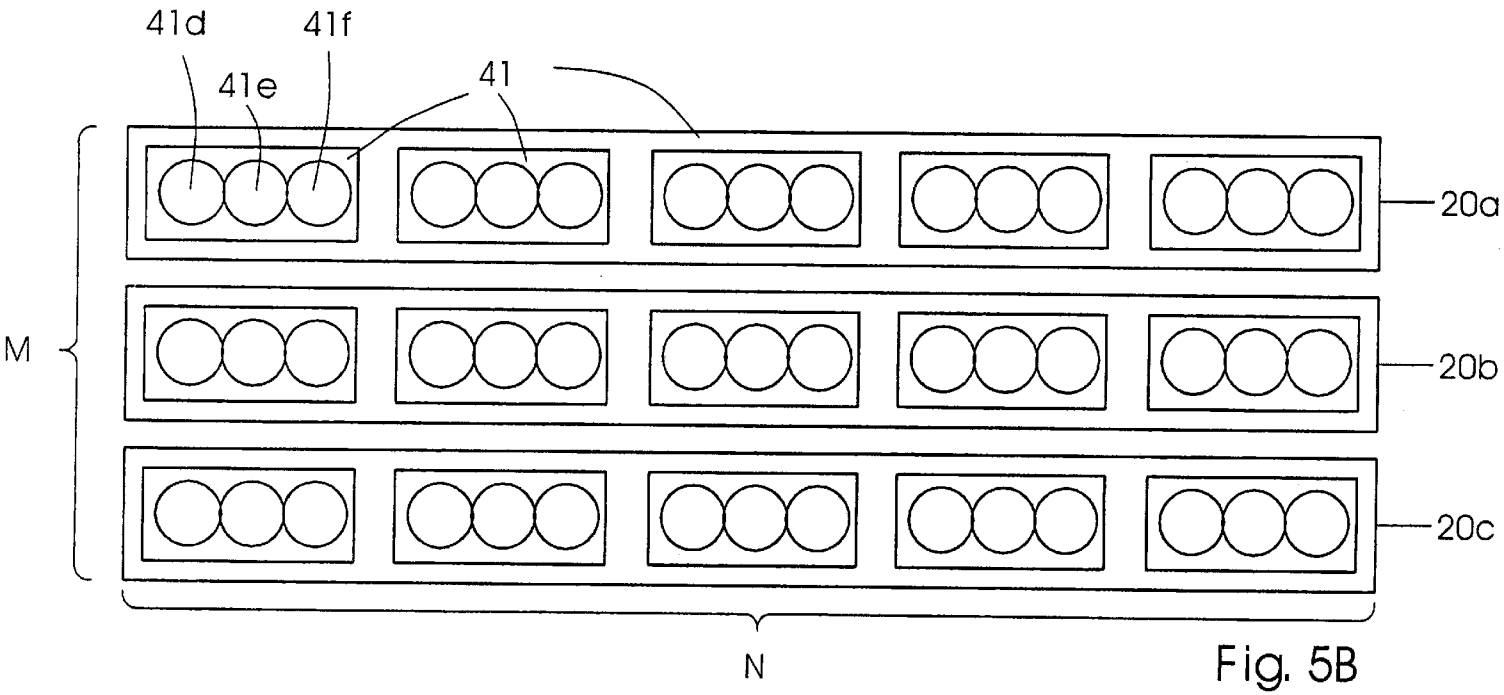
FIG. 5B shows a schematic view of the spray nozzle arrangement of another embodiment of the spray dampening device according to the present invention having three rows of grouped spray nozzles.

Referring now to FIG. 5B, in another embodiment of the invention, several spray bars 20 having groups 41 of three nozzles 41*d*, 41*e* and 41*f*, as in the embodiment shown in FIG. 5A, may be arranged to form an M×N rectangular array of M rows and N columns of nozzle groups. An exemplary embodiment having 3 rows a, b, c of spray bars 20*a*, 20*b* and 20*c*, respectively, is depicted in FIG. 5B. In a spray bar 20*a*, 20*b* or 20*c*, the nozzles in each group preferably cycle with a time delay pattern synchronized with corresponding nozzles in other groups, as described above with respect to the single spray bar 20 shown in FIG. 5A. As embodied herein, the cycling of nozzle rows a, b and c are phase-shifted relative to each other so that nozzles on spray bar 20*b* are synchronized to cycle with a predetermined time delay after the corresponding nozzles on spray bar 20*a*, and nozzles on spray bar 20*c* are synchronized to cycle with a predetermined time delay after the corresponding nozzles on spray bar 20*b*. Preferably, the time delays between the nozzle bars are the same. In other embodiments of the present invention cycling phase shifts may be applied on a nozzle group column basis, so that the nozzle groups in individual columns of the M×N array nozzle are phase shifted relative to other columns in the array. In this way, a two-dimensional phase shift scheme may be applied to the nozzle array.

While the present invention has been described in conjunction with specific embodiments thereof, various alternatives, modifications and variations will be apparent to those skilled in the art. Accordingly, the preferred embodiments of the present invention set forth herein are intended to be illustrative, not limiting. Various changes may be made without departing from the spirit and scope of the present invention as defined in the claims. For example, various nozzle array configurations, such as trapezoidal-shaped, for example, or combinations of nozzle groups in a regular or irregular geometric configurations with various numbers of nozzles in a group may be used, without departing from the scope of the present invention. Also, various nozzle cycling phase-shift schemes, with, for example, variations in nozzle duty cycles, other than those described herein, may be used. These and other variations are intended to be within the scope of the present invention as limited only by the following claims.

What is claimed is:

1. A spray dampening device for a printing apparatus, the spray dampening device comprising a plurality of spray nozzles for applying spray bursts to a surface of a target of a printing apparatus, the spray nozzles being oriented at the same general area on the surface of the target so that the spray bursts spray the same general area, each of the spray nozzles being adapted to be cycled at a predetermined frequency and at an individual nozzle phase shift, the individual nozzle phase shifts being synchronized so that an effective frequency of individual, sequential spray bursts applied to the same general area of the surface is greater than the predetermined frequency, the effective frequency being a frequency in rotational direction of the target as the surface moves past the plurality of nozzles.

2. The device as recited in claim 1 wherein the spray nozzles are arranged in a plurality of M rows, M being an integer, each row including at least one spray nozzle, the individual nozzle phase shift of each of the at least one spray nozzle in each row being equal to an individual row phase shift, the individual row phase shifts being synchronized so that the effective frequency of spray bursts applied to the target surface is M times the predetermined frequency.

3. The device as recited in claim 2 wherein the plurality of rows of spray nozzles is oriented so that the rows are generally orthogonal to a direction of motion of the target.

4. The device as recited in claim 1 wherein the target is a roller and the spray nozzles are arranged in a plurality of M rows, M being an integer, the rows running orthogonal to a longitudinal axis of the roller end and including at least one spray nozzle, the individual nozzle phase shift of each of the at least one spray nozzle in each row being equal to an individual row phase shift, the individual row phase shifts being synchronized so that the effective frequency of spray bursts applied to the target surface is M times the predetermined frequency.

5. A spray dampening device for a printing apparatus, the spray dampening device comprising a plurality of spray nozzles arranged in a plurality of rows so as to form an array of spray nozzles, the spray nozzles being arranged in groups, each group of spray nozzles applying spray bursts to a surface of a target of a printing apparatus, each group of the spray nozzles being oriented at the same general area on the surface of the target so that the spray bursts spray the same general area, each of the spray nozzles being adapted to be cycled at a predetermined frequency and at an individual nozzle phase shift, the individual nozzle phase shifts being synchronized so that an effective frequency of individual, sequential spray bursts applied to the same general area of the surface is greater than the predetermined frequency, the effective frequency being a frequency in rotational direction of the target as the surface moves past the plurality of nozzles.

6. A spray dampening device for a printing apparatus, the spray dampening device comprising a plurality of spray nozzles arranged in at least one row, the spray nozzles of each of the at least one row being arranged in a plurality of groups including at least two spray nozzles, each group of the plurality of groups of spray nozzles being oriented at the same general area on the surface of the target so that the spray bursts from each group of spray nozzles spray the same general area, each of the spray nozzles in a group being adapted to be cycled at a predetermined frequency and at an individual nozzle phase shift, the individual nozzle phase shifts being synchronized so that an effective frequency of individual, sequential spray bursts applied to the same general area of the surface is greater than the predetermined frequency, the effective frequency being a frequency in rotational direction of the target as the surface moves past the plurality of nozzles.

7. The device as recited in claim 6 wherein each group includes an equal number of spray nozzles, the phase shifts of the e spray nozzles in each group being synchronized so that the effective frequency of spray bursts applied to target is equal to the predetermined frequency times the number of spray nozzles in each group.

8. A method for spray dampening a printing device, the method comprising the steps of:

spraying a dampening solution in spray bursts through a plurality of spray nozzles to a surface of a target of a printing apparatus, wherein each spray nozzle sprays the same general area of the target so that the spray bursts substantially overlap; and cycling each of the spray nozzles at a predetermined frequency and at an individual nozzle phase shift, the individual nozzle phase shifts being synchronized so that an effective frequency of spray bursts applied to the same general area is greater than the predetermined frequency.

9. The method as recited in claim 8 wherein the spray nozzles are arranged in a plurality of M rows, M being an integer, each row including at least one spray nozzle, the individual nozzle phase shift of each of the at least one spray nozzle in each row being equal to an individual row phase shift, the individual row phase shifts being synchronized so that the effective frequency of spray bursts applied to the target surface is M times the predetermined frequency.

10. The method as recited in claim 9 wherein the plurality of rows of spray nozzles is oriented so that the rows are generally orthogonal to a direction of motion of the target.

11. The method as recited in claim 8 wherein the spray nozzles are arranged in at least one spray nozzle row, the at least one spray nozzle row running generally parallel to an axis of the roller.

12. The method as recited in claim 8 wherein the spray nozzles are arranged in at least one row, the spray nozzles of each of the at least one row being arranged in a plurality of groups including at least two spray nozzles.

13. The method as recited in claim 12 wherein each group includes an equal number of spray nozzles, the phase shifts of the spray nozzles in each group being synchronized so that the effective frequency of spray bursts applied to target is equal to the predetermined frequency times the number of spray nozzles in each group.

14. The method as recited in claim 12 wherein the groups are arranged in a plurality of rows and columns so as to form a rectangular array of groups of spray nozzles, each group of spray nozzles in an individual row and an individual column being phase-shifted relative to corresponding spray nozzles in the same individual column of at least one other row.

15. A spray dampening device for a printing apparatus, the spray dampening device comprising:

a row of spray nozzles for applying spray bursts to a surface of a rotating roller in a printing apparatus, wherein each of the spray nozzles in the row of spray nozzles is oriented at a same general area on the surface of the roller so that the spray bursts from each of the spray nozzles sprays the same general area on the surface of the roller, and wherein each of the spray nozzles in the row of spray nozzles is adapted to be cycled at a predetermined frequency and at an individual nozzle phase shift, the individual nozzle phase shifts being synchronized so that an effective frequency of individual, sequential spray bursts applied to the same general area of the surface is greater than the predetermined frequency, the effective frequency being a frequency in rotational direction of the roller as the surface moves past the plurality of nozzles.

16. A spray dampening device for a printing apparatus, the spray dampening device comprising:

a plurality of rows of spray nozzles for applying spray bursts to a surface of a rotating roller in a printing apparatus, wherein each of the spray nozzles in one row of the plurality of rows of spray nozzles is oriented at a same general area on the surface of the roller so that the spray bursts from each of the spray nozzles in one row of the plurality of rows of spray nozzles sprays the same general area on the surface of the roller, and wherein each row of the plurality of rows of spray nozzles is oriented at a different general area on the surface of the roller, and wherein each of the spray nozzles in the row of spray nozzles is adapted to be cycled at a predetermined frequency and at an individual nozzle phase shift, the individual nozzle phase shifts being synchronized so that an effective frequency of individual, sequential spray bursts applied to the same general area of the surface by one row of spray nozzles is greater than the predetermined frequency, the effective frequency being a frequency in rotational direction of the roller as the surface moves past the plurality of nozzles.

17. A spray dampening device according to claim 16, wherein the rows of spray nozzles are oriented generally orthogonal to an axis of rotation of the roller.

18. A spray dampening device according to claim 16, wherein the rows of spray nozzles are oriented generally parallel to an axis of rotation of the roller.

19. A spray dampening device for a printing apparatus, the spray dampening device comprising:

a plurality of groups of spray nozzles for applying spray bursts to a surface of a rotating roller in a printing apparatus, wherein each of the spray nozzles in one group of the plurality of groups of spray nozzles is oriented at a same general area on the surface of the roller so that the spray bursts from each of the spray nozzles in one group of the plurality of groups of spray nozzles sprays the same general area on the surface of the roller, and wherein each group of the plurality of groups of spray nozzles is oriented at a different general area on the surface of the roller, and wherein each of the spray nozzles in one group of the plurality of groups of spray nozzles is adapted to be cycled at a predetermined frequency and at an individual nozzle phase shift, the individual nozzle phase shifts being synchronized so that an effective frequency of individual, sequential spray bursts applied to the same general area of the surface by one group of spray nozzles is greater than the predetermined frequency, the effective frequency being a frequency in rotational direction of the roller as a surface of the roller moves past the plurality of nozzles.

20. A spray dampening device according to claim 19, wherein each group of spray nozzles is formed by a row of spray nozzles.

21. A spray dampening device according to claim 20, wherein the rows of spray nozzles are orthogonal to an axis of rotation of the roller.

22. A spray dampening device according to claim 20, wherein the rows of spray nozzles are oriented generally parallel to an axis of rotation of the roller.

* * * * *